United States Patent [19]

Patton

[11] 4,223,793

[45] Sep. 23, 1980

[54] CHILD RESISTANT CLOSURE

[75] Inventor: John S. Patton, Baton Rouge, La.

[73] Assignee: Ethyl Corporation, Baton Rouge, La.

[21] Appl. No.: 34,354

[22] Filed: Apr. 30, 1979

[51] Int. Cl.[2] ..... B65D 55/02

[52] U.S. Cl. ..... 215/220; 215/303

[58] Field of Search ..... 215/220, 302, 303

[56] References Cited

U.S. PATENT DOCUMENTS

| | | | |
|---|---|---|---|
| 3,669,294 | 6/1972 | Petronelli et al. | 215/220 |
| 3,977,554 | 8/1976 | Costa | 215/220 |

*Primary Examiner*—George P. Hall

*Attorney, Agent, or Firm*—Charles L. Lovercheck

[57] ABSTRACT

A child resistant closure or a container having a cap member and an outer ring. The cap has a lower internal threaded section and an outwardly directed flange with downwardly directed teeth at its top with a cylindrical part therebetween. The ring has internal threads and a flange with upwardly extending teeth. When the ring is rotated it first climbs up the threads on the cap and then can be lifted along the cylindrical part to bring the teeth on the ring into mesh with the teeth on a cap so that furthe rotation of the ring rotates the cap loosening it.

8 Claims, 13 Drawing Figures

CHILD RESISTANT CLOSURE

GENERAL DESCRIPTION OF THE INVENTION

A child resistant closure enclosed which can be applied by automatic capping devices and the customer can easily remove it and it can be constructed from a variety of raw materials. The closure is applied to the container by normal clockwise motion which secures the outer ring downward onto the inner cap and seats itself on outwardly curled wire of the inner cap, thus transmitting the turning force of the ring to the inner cap which in turn screws the inner cap onto the container. The closure is removed by lifting the outer ring, sliding it upward, so that the notches on its top edge engages a mating section on the inner cap and turning the ring counterclockwise. The ring is retained on the inner cap between the bottom wire of the inner cap which restricts the downward movement of the upper wall of the inner cap which has been deformed so that it collapses outwardly and over the notched section of the ring restricting its upward movement.

When using a metal inner cap, its construction is very inexpensive, but more important is the metal top which is exposed and which allows it to show a color design which may be very inexpensive applied to decorate the cap.

The cap may be automatically applied to containers on standard cap equipment with no modification and the cap is more receptive to the elderly which have difficulty operating closures that are presently marketed because of the use of pressure to make the concept function.

The outer ring having the top of the inner cap exposed requires an up and down sliding motion to achieve the concept as opposed to the normal squeezing technique, which is presently available.

REFERENCE TO PRIOR ART

Prior patents on outer resistant covers are shown in U.S. Pat. Nos. 2,710,701; 3,308,979; 3,435,978; 3,604,582; 3,757,979; 4,089,432; 3,923,185; 3,923,184; 3,904,059; 4,036,385; 3,782,755; 3,269,576; 3,656,646; 3,630,403; 3,308,979; 4,090,629 and 3,888,373. None of the above mentioned patents show the combination of elements that achieve the above mentioned results.

OBJECTS OF THE INVENTION

It is an object of the invention to provide an improved child resistant cover.

Another object of the invention is to provide a child resistant cover that is simple in construction, economical to manufacture, and simple and efficient to use.

Another object of the invention is to provide an improved child resistant cover wherein the cap has downwardly facing teeth and a ring around the cap has upwardly facing teeth so that when the ring is held up in engagement with the teeth of the cap the cap can be rotated by cutting a force on the ring.

With the above and other objects in view, the present invention consists of the combination and arrangement of parts hereinafter more fully described, illustrated in the accompanying drawing and more particularly pointed out in the appended claims, it being understood that changes may be made in the form size, proportions and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
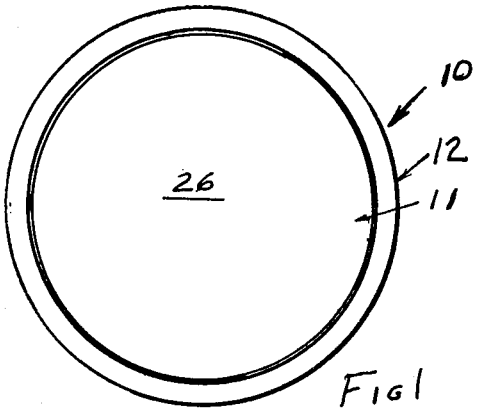
FIG. 1 is a top view of the container closure according to the invention.
Figure 4:
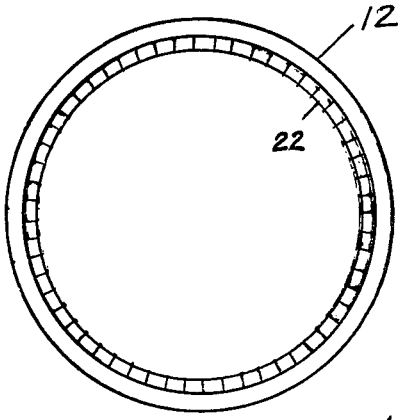
FIG. 4 is a top view of the ring.
Figure 2:
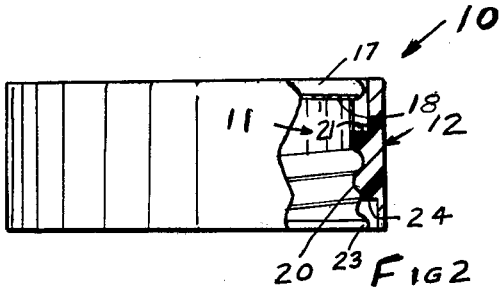
FIG. 2 is a side view partly in cross section of the container closure.
Figure 5:
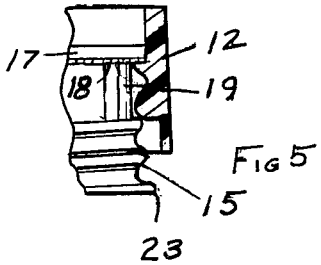
FIG. 5 is a partial view of the container closure in combination with the ring rotated to position for opening the closure.
Figure 3:
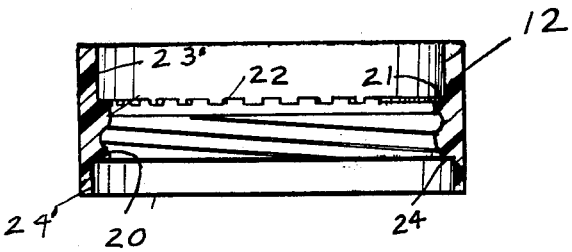
FIG. 3 is a longitudinal cross sectional view of the ring.
Figure 6:
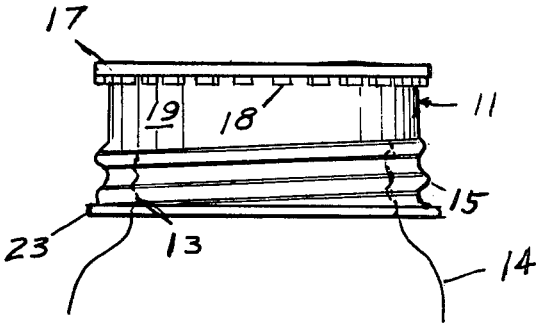
FIG. 6 is a side view of the cap.

Now, with more particular reference to the drawings, the child resistant closure 10 is made up of a cap 11 and an outer ring 12. The cap has internal threads 13 adapted to be received on the external threads around the neck of a container 14 and external thread 15 on the outer periphery of the cap. Threads 15 extend part way up the side of the cap. The cap has a downwardly facing flange 17 on its upper end and the flange 17 has downwardly extending teeth 18. A cylindrical portion 19 is disposed below downwardly directed flange 17. The outer periphery of the cap has the generally cylindrical smooth portion 19 between the flange 17 and the threads 18. The ring 12 has upwardly directed flange 21 and integral with this flange 21 are the upwardly extending teeth 22. The closure is applied to a container by normal clockwise motion of the outer ring which moves down on the inner cap 11 and seats its peripheral flange 24 on a second outwardly curled flange 23 of the cap; thus transmitting the turning force of the ring 12 to the inner cap 11 which in turn screws the inner cap onto the container 14.

Removal of the container is accomplished by lifting the outer ring 12 upward so that peripheral flange 25 surrounds flange 17 and its teeth 22 engage the teeth 18 on the flange 21 on the inner cap. Turning ring 12 counterclockwise, the ring is retained on the inner cap 11 by the bottom flange 23 of the inner cap which limits the downward movement of the ring by the upper wall of the inner cap which has been deformed so that it collapses outwardly and over the notched section of the ring restricting its upward movement.

The cap has a closed upper end 26 and generally cylindrical body extending downwardly thereform.

The body is made up of the cylindrical portion 19 that extends downward from the outwardly extending flange which has the teeth 18 extending downward. The cylindrical portion 19 joins the external threaded portion 15 which terminates at its lower end in the outwardly extending flange 23. The ring 12 has the intermediate internal threads 20 that terminate at their upper side in the shoulder 21 which has spaced notches that define teeth 22 on its upper end. The upwardly extending peripheral flange 23' extends upwardly from the teeth at a slightly larger diameter and the downwardly extending peripheral flange 24 extends downwardly from the threads 15 at a slightly larger diameter.

When the threads 20 of the ring 12 are received on the external thread 15 of the cap 11, the ring can be rotated clockwise bringing the shoulder 27 against the flange 23 stopping the relative rotation between ring and cap so that the cap can be tightened. When the ring 12 is rotated counterclockwise the internal threads of the ring 16 move up along the threads 15 on the cap until the internal threads 20 are disposed over the cylindrical surface 19. The cap can then be lifted until the teeth 22 on the ring engage the teeth 18 on the cap. The rotation of the ring can then be continued turning the cap 11 off of the container 14. When the cap 11 is moved up to its upper most position, the flange 23' will slidably receive the flange 17 holding the cap and ring in alignment. When the cap is in its lower position, the flange 24' will receive the wire 23 holding the cap and ring in alignment.

Figure 7:
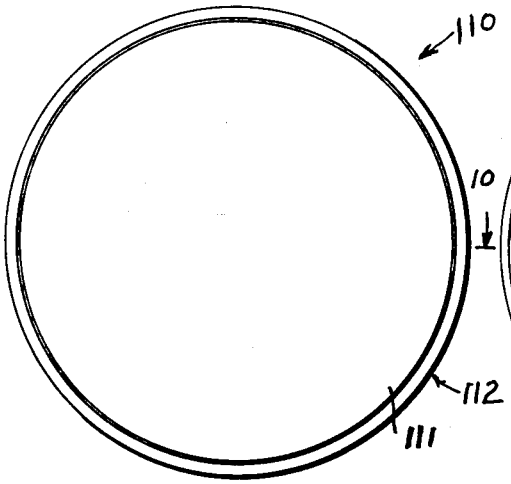
FIG. 7 is a top view of another embodiment of the invention.
Figure 8:
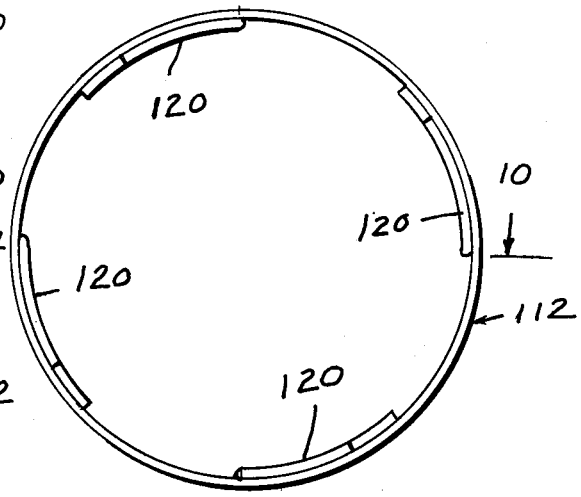
FIG. 8 is a top view of the ring of the embodiment of FIG. 7.
Figure 9:
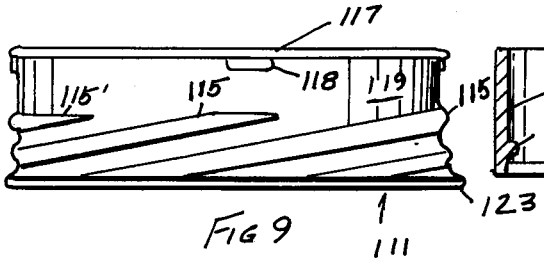
FIG. 9 is a side view of the cap of the embodiment of FIG. 8.
Figure 10:
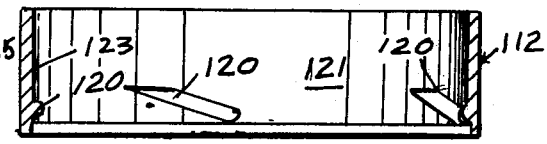
FIG. 10 is a longitudinal cross sectional view taken on Line 10—10 of FIG. 8.
Figure 11:
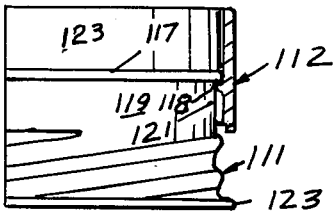
FIG. 11 is a partial view partly in cross section of the embodiment of the invention shown in FIGS. 7 through 10 and showing the cap removed and outer shell locked.
Figure 12:
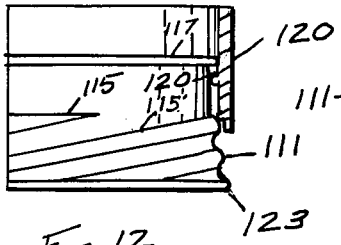
FIG. 12 is a view similar to FIG. 11 showing the cap and ring just before the inner lugs engage the downward extending lugs on the cap.
Figure 13:
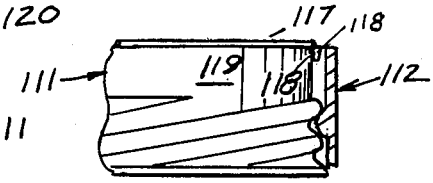
FIG. 13 is a view partly in cross section showing the cap outer shell lock as when rotated counterclockwise for tightening the cap on a container.

In the embodiment of FIGS. 7 through 13 a container cover 110 is shown comprising a cap 111 and an outer ring 112. The cap 111 has internal threads adapted to be received on a container in a conventional manner. The outer periphery of the cap is divided into a lower externally threaded part, an intermediate smooth cylindrical part and an upper part with flange. The lower part of the cap has external threads thereon which may be a molded thread design as shown in the embodiment, threads are indicated at 115 and 115'. The intermediate cylindrical portion 119 is between the flange 117 and the threads 115 is generally cylindrical and the upper flange 117 has downward directed lugs 118 thereon.

The ring 112 has an inner cylindrical surface 123 and spaced interrupted threads 120. When the ring is turned counterclockwise the spaced lugs 120 ride up on the cap threads 115 and 115' and the lugs 120 move up to a position shown in FIG. 11 and as the ring is further lifted and rotated counterclockwise the ring moves upward over the cylindrical part and the threads 120 engage the lugs 118 and transmit force from the ring to the cap to unscrew the cap from the can.

The multiple threads 115 and 115' may be double threads, triple threads or any other suitable number of threads and said spaced lugs 120 on said ring may be of any suitable length and spacing according to the desires of the designer. When the ring is rotated counterclockwise lug 120 will first move up into engagement with the teeth 118 in the position shown in FIG. 11 and as rotation of the ring is continued the lugs 120 will engage the downward extending lugs 118 causing said cap to rotate with the ring. The teeth 118 may be bumps on said cap in metal cover design or in plastic caps the lugs may be plastic. The internal threads 120 may be formed inwardly on the ring in metal design.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A child resistant cap (10) comprising,
a cap member (11) and an outer ring (12),
said cap member having an internal thread (13) adapted to be received on a container (14),
an external thread (15) on the outer periphery of said cap,
said external thread extending upward along the lower part of said cap,
an outwardly directed flange (17) on the upper edge of said cap member (11),
the outer periphery of said cap between said flange (17) and said thread being a generally smooth cylindrical portion,
downwardly directed teeth (18) on said outwardly directed flange (17) on the side thereof adjacent said cylindrical portion,
an internally threaded portion on said ring terminating at its upper end in spaced teeth (22) on the upper edge (18) of said threaded portion,
said external threads on said cap terminating at the lower side in a second outwardly directed flange (23),
said ring (12) being adapted to be received on said cap with said internal threads engaging said external threads on said cap and engaging said second flange and said threads on said ring being adapted to receive said cylindrical portion of said cap.

2. A closure (10) for a container (14) comprising,
a cap (11) and a ring (12),
said cap (11) having a closed top (29) and a generally cylindrical body adapted to receive the top of a closure (14),
internal means (13) on said cap (11) securing said cap (11) to said container (14),
said body having a cylindrical portion (19) fixed to said top,
an upper flange (17) attached to said top (29) above said cylindrical portion and having downwardly extending teeth (18) thereon,
said body having an externally threaded portion (15) joining said cylindrical portion (19) and terminating at its lower end in an a second outwardly directed flange (23),
said ring having an intermediate threaded portion (20) terminating at its top in an upwardly facing shoulder having upwardly extending teeth (22) thereon and upwardly extending peripheral flange extending upwardly from said ring (12) spaced outwardly from said upwardly extending teeth (22),
a said threaded portion (16) on said ring terminating at its lower end in a downwardly facing shoulder and a downwardly extending peripheral flange (24) extending downwardly from said downwardly facing shoulder,
said ring (12) being received on said cap (12) between said downwardly extending teeth (18) and said outwardly directed flange (23),
said threaded portion (16) on said ring (12) being adapted to be threadably received on said external threads (15) on said cap (11) and said downwardly extending portion adapted to butt against said second outwardly directed flange (23) when said ring is turned in a counterclockwise direction whereby said cap is tightened on said container, said ring (12) being adapted to be moved upwardly when rotated in a counterclockwise direction whereby said internal threads move over said cylindrical portion on said cap and said upwardly extending teeth (21) on said ring intermesh with said downwardly extending teeth (18) on said cap (11) whereby said cap (11) may be rotated in a counterclockwise direction.

3. A container cover comprising a cap (10) and an outer ring (12), said cap (11) having internal threads adapted to engage the external threads on the neck of a container, a portion of said cap adjacent to said container having threads (15) thereon and said threads terminating in a first outwardly directed flange at the lower end, said cap (11) having a second outwardly directed flange (17) at its end remote from said threads, the part (19) of said cap between said threads and said flange being cylindrical, circumferentially spaced downwardly directed lugs (18) on said second flange (17), said ring (12) having an inner cylindrical surface, spaced inclined lugs (22) on the inner periphery of said ring (12), said lugs (22) on said ring (12) being adapted to engage said lugs (18) on said cap (11) when said ring is rotated and pushed towards said container and turned counterclockwise the said internal threads on said ring into engagement with said flange to tighten said cap onto said container, said ring being adapted to be turned counterclockwise and lifted in a direction away from said container by said lug, said ring being adapted to move away from said external threads on said cap and said internal lugs on said ring to engage said downwardly directed teeth on said flange whereby said cap is rotated and removed from said container.

4. The container recited in claim 3 wherein said ring is made of thin metal and said inwardly directed lugs are formed inwardly.

5. The closure recited in claim 4 wherein said downwardly directed teeth are spaced at 90° intervals around said cap.

6. The closure recited in claims 1 or 4 wherein said spaced inclined lugs comprise interrupted threads.

7. a closure comprising, a cap, releasable means on said cap to attach said cap to a container, said releasable means being adapted to attach said cap to a container when said cap is rotated in a first direction and to release said cap from said container when said cap is rotated in a second direction, cam means on said cap, first tooth means on said cap spaced in a first direction of said cam means on said cap and second tooth means on said cap spaced from a second side of said cam means on said cap, a ring, internal cam means on said ring, said ring adapted to engage said cam means, first tooth means on said ring on the first side thereof and second tooth means on said ring at a second side thereof, said cam means on said ring being adapted to engage said cam means on said cap to move said ring toward said first tooth means on said cap when said ring is rotated in a first direction, said cam means on said ring being adapted to disengage said cam means on said cap and said ring being adapted to be lifted to bring said first tooth means on said ring into engagement with said first tooth means on said cap whereby said cap is rotated with said ring.

8. The closure recited in claim 7 wherein said ring is adapted to rotate in a second direction whereby said cam means on said cap moves said ring toward said second tooth means on said cap and said ring is adapted to be moved from said cam means on said cap to engage means on said cap whereby said cap may be loosened.

* * * * *

UNITED STATES PATENT AND TRADEMARK OFFICE

CERTIFICATE OF CORRECTION

PATENT NO. : 4,223,793

DATED : September 23, 1980

INVENTOR(S) : John S. Patton

It is certified that error appears in the above-identified patent and that said Letters Patent are hereby corrected as shown below:

Abstract, line 10 reads "furthe", should read
-- further --

Column 4, line 48 reads "in an a" should read
-- in a --

Signed and Sealed this

Fourth Day of May 1982

[SEAL]

Attest:

GERALD J. MOSSINGHOFF

Attesting Officer

Commissioner of Patents and Trademarks